US006996998B2

(12) United States Patent
Lifson et al.

(10) Patent No.: US 6,996,998 B2
(45) Date of Patent: Feb. 14, 2006

(54) REFRIGERANT SYSTEM PRESSURE CONTROL FOR STORAGE AND TRANSPORTATION

(75) Inventors: Alexander Lifson, Manlius, NY (US); Michael F. Taras, Fayetteville, NY (US); Thomas J. Dobmeier, Phoenix, NY (US)

(73) Assignee: Carrier Corporation, Syracuse, NY (US)

( * ) Notice: Subject to any disclaimer, the term of this patent is extended or adjusted under 35 U.S.C. 154(b) by 0 days.

(21) Appl. No.: 10/742,038

(22) Filed: Dec. 19, 2003

(65) Prior Publication Data

US 2005/0132728 A1 Jun. 23, 2005

(51) Int. Cl.
*F25B 45/00* (2006.01)
*F25B 41/00* (2006.01)

(52) U.S. Cl. ..... 62/149; 62/174

(58) Field of Classification Search ..... 62/149, 62/174

See application file for complete search history.

(56) References Cited

U.S. PATENT DOCUMENTS 4,876,859 A 10/1989 Kitamoto
4,942,741 A * 7/1990 Hancock et al. ..... 62/292
5,167,126 A * 12/1992 Cartwright ..... 62/129
5,319,945 A * 6/1994 Bartlett ..... 62/174
5,542,261 A * 8/1996 Albertson et al. ..... 62/174
5,720,184 A * 2/1998 Olsen ..... 62/292
5,768,895 A * 6/1998 Albertson et al. ..... 62/77
5,875,637 A 3/1999 Paetow
6,047,556 A 4/2000 Lifson
6,112,532 A * 9/2000 Bakken ..... 62/174
6,178,759 B1 * 1/2001 Key ..... 62/149
6,206,652 B1 3/2001 Caillat

OTHER PUBLICATIONS

Systems & Advanced Technologies Engineering S.r.I., publication entitled "Compsys—Dynamic Simulation of Gas Compression Plants".
Copeland Application Guideline for Refrigeration Scroll for Parallel Applications.

* cited by examiner

*Primary Examiner*—Melvin Jones
*Assistant Examiner*—Filip Zec
(74) *Attorney, Agent, or Firm*—Carlson, Gaskey & Olds

(57) ABSTRACT

An air conditioning or refrigeration system includes an attached refrigerant receptacle associated with the system. During shipment or storage, the pressure within the system may exceed a selected threshold for the low pressure side. Under such circumstances, a pressure relief device automatically allows refrigerant to flow from the system into the attached receptacle, which brings the pressure within the system back to an acceptable level for the low pressure side. Various optional shutoff devices are disclosed that can be incorporated into the design to simplify receptacle removal or recycling.

6 Claims, 2 Drawing Sheets

REFRIGERANT SYSTEM PRESSURE CONTROL FOR STORAGE AND TRANSPORTATION

FIELD OF THE INVENTION

This invention generally relates to refrigerant systems. More particularly, this invention relates to controlling pressure within an air conditioning or refrigeration system during storage or transportation.

DESCRIPTION OF THE RELATED ART

Air conditioning systems typically utilize a refrigerant to achieve a desired amount of cooling within a building, for example. Systems typically are charged at a factory with an amount of refrigerant to provide adequate system performance for expected operating conditions.

The refrigerant system can be divided into low and high pressure sides. The low pressure side is the system side that is exposed to lower, suction pressure during operation. The high pressure side is the system side that is exposed to higher, discharge pressure during operation. During operation the discharge pressure is normally several times higher than suction pressure. However, when the system is shutdown, both suction and discharge pressure equal each other soon after shutdown.

The low pressure side of the system reaches the highest pressure during system transportation or storage. The pressure in the low pressure side during transportation or storage can be several times higher than the maximum pressure the low side of the system experiences during normal system operation. The system components typically must be designed with a safety margin sufficient to withstand such pressure. The associated increases in component strength cause increased component cost and weight.

With the introduction of higher pressure refrigerants, such as R410A, the above concerns are increased. Additionally, certain governing bodies are introducing new, more stringent high pressure strength requirements. It is desirable to provide a cost-effective way to deal with this situation.

This invention provides a way to manage the pressure within the refrigerant system during transportation or storage that avoids the shortcomings and drawbacks described above.

SUMMARY OF THE INVENTION

In general terms, this invention is a unique way of managing the pressure within a refrigerant system during transportation or storage.

One example system designed according to an embodiment of this invention includes a refrigerant receptacle and a pressure relief device that couples the receptacle to the system. The pressure relief device operates responsive to a pressure in the system that exceeds a selected threshold. Accordingly, refrigerant from the system can flow into the refrigerant receptacle whenever the pressure in the system exceeds the threshold.

In one example, the pressure relief device includes a valve that will automatically open responsive to an undesirably high pressure in the system and release the refrigerant into the receptacle. The receptacle provides additional volume within which the refrigerant can be contained, which reduces the pressure in the system. This approach avoids the necessity of over-designing the air conditioning system low pressure side components, such as a compressor and an evaporator, and, therefore, provides an associated cost savings. Various shutoff and recovery valves and devices can be added to the receptacle for convenience, as well.

The various features and advantages of this invention will become apparent to those skilled in the art from the following detailed description of the currently preferred embodiment. The drawings that accompany the detailed description can be briefly described as follows.

DETAILED DESCRIPTION OF THE PREFERRED EMBODIMENT

Figure 1:
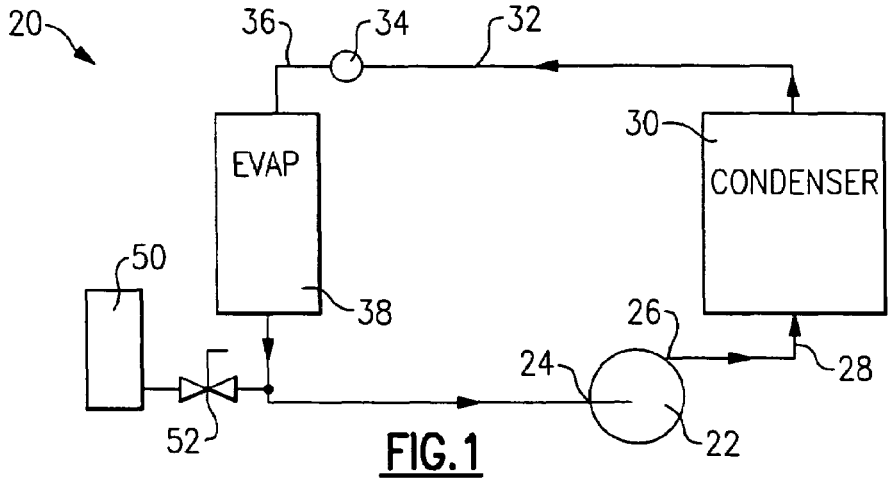
FIG. 1 schematically illustrates a refrigerant system including a refrigerant receptacle for managing a pressure within the system during transportation or storage, for example.

FIG. 1 schematically shows a refrigerant system 20 that may be used as a refrigeration system, a heat pump or an air conditioning system. In a cooling mode, a compressor 22 draws refrigerant from a suction port 24 and provides a compressed gas under pressure to a compressor discharge port 26. The high temperature, pressurized gas flows through a conduit 28 to a condenser 30 where the gas dissipates heat and condenses into a liquid as known. The liquid refrigerant flows through a conduit 32 to an expansion device 34. In one example, the expansion device 34 is a valve that operates in a known manner to allow the liquid refrigerant to expand and to partially evaporate and flow into a conduit 36 in the form of a cold, low pressure refrigerant. This refrigerant then flows through an evaporator 38 where the refrigerant absorbs heat from air that flows across the evaporator coils, which provides cooled air to the air conditioned space as known. The refrigerant exiting the evaporator 38 flows through a conduit 40 to the suction port 24 of the compressor 22 where the cycle continues. As known, during a heating mode, the refrigerant flows are reversed.

The system 20 has a high pressure side, in which the components are exposed to discharge pressure, between the discharge section of the compressor 22 and the entrance to the expansion device 34. A low pressure side, in which the components are exposed to suction pressures, exists between the exit from the expansion device 34 and the suction section of the compressor 22.

The illustrated example includes an external refrigerant receptacle 50 that is coupled to the system for selective fluid communication. In this example, a pressure relief device 52 selectively allows refrigerant to flow from the system into the receptacle 50 whenever the pressure in the system exceeds a selected threshold. By coupling the receptacle 50 to the system, the example arrangement effectively increases the volume within which the refrigerant can be contained, which reduces the pressure. Accordingly, whenever the pressure in the system exceeds a selected threshold for the low pressure side, adding the volume of the external receptacle 50 to the system volume allows the pressure in the system to be brought back down to an acceptable level.

In one example, the threshold is dictated by the chosen refrigerant, system component strength on the system low pressure side or the limits set by an appropriate regulatory or governing body. Those skilled in the art who have the benefit of this description will be able to select an appropriate threshold to suit their particular situation.

Figure 2:
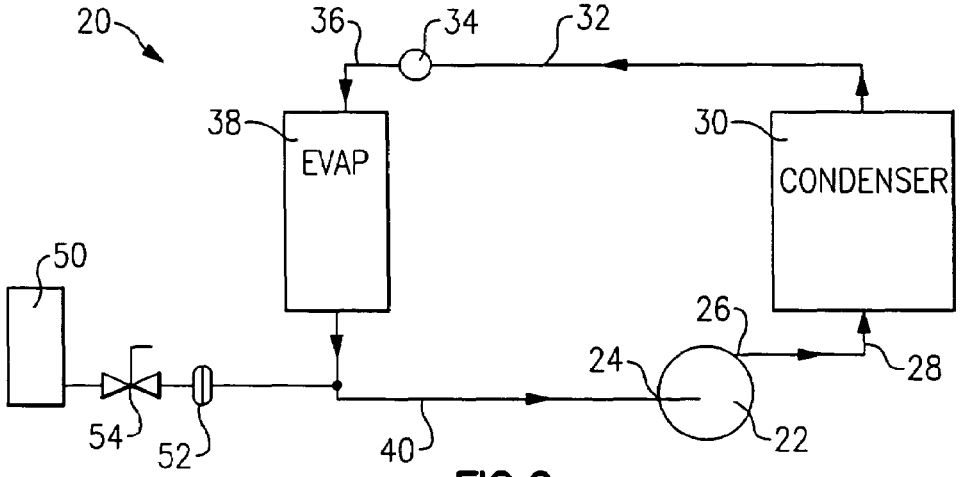
FIG. 2 schematically illustrates another example arrangement of a system designed according to this invention.

In another example as shown in FIG. 2, an optional valve 54 is provided. The flow control valve 54 is a shut-off valve that allows for selectively isolating the receptacle 50 from the relief device 52, which in this example is a rupture disk, or the system. In this example, the valve 54 is utilized in case the receptacle 50 is removed from the system and needs to be installed once again in other units for same purpose during transportation or storage. It also can be used if the rupture disk 52 was ruptured due to pressure in the system 20 exceeding the allowable pressure threshold and just the receptacle needs to be removed to be reused, for example.

Another example designed according to the embodiment of FIG. 2 has a flow control valve 54 that operates as a check valve to allow flow of refrigerant in only one direction from the system to the receptacle 50.

Figure 3:
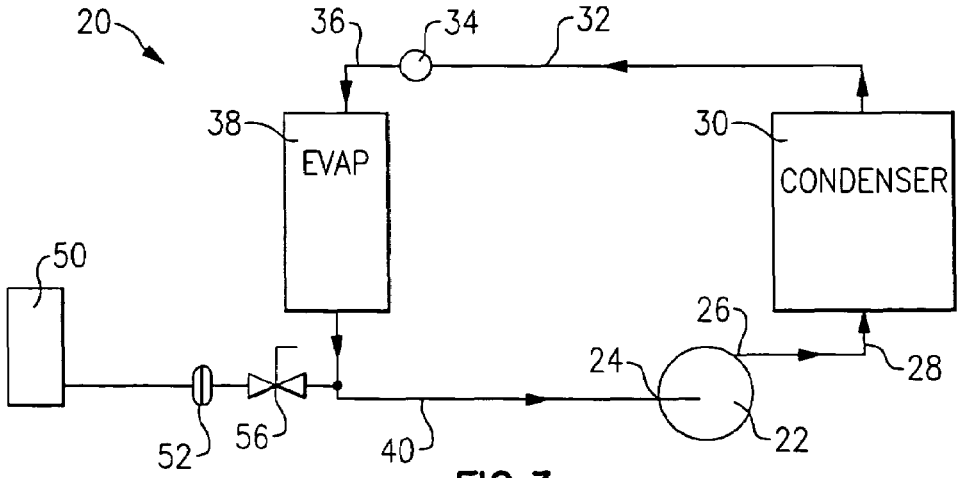
FIG. 3 schematically illustrates another example arrangement of a system designed according to this invention.

In another example shown in FIG. 3, an optional valve 56 is provided to selectively isolate the rupture disk 52 along with the receptacle 50 from the rest of the system 20 for recycling or any other purpose. Although the receptacle 50 and the rupture disk 52 are shown associated with the conduit 40, a connection to any appropriate part of the system is within the scope of this invention.

Figure 4:
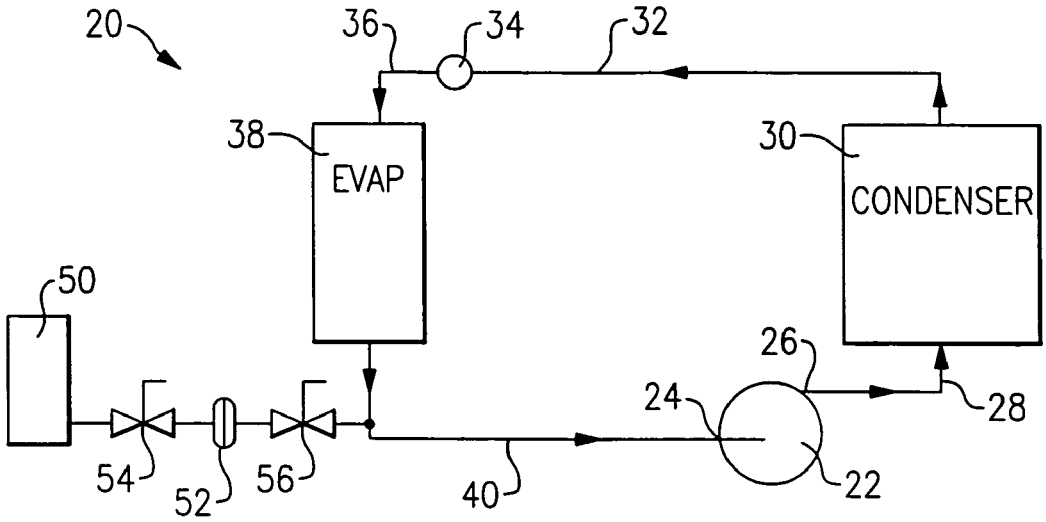
FIG. 4 schematically illustrates another example arrangement of a system designed according to this invention.

FIG. 4 illustrates another example embodiment that includes both optional valves 54 and 56.

Figure 5:
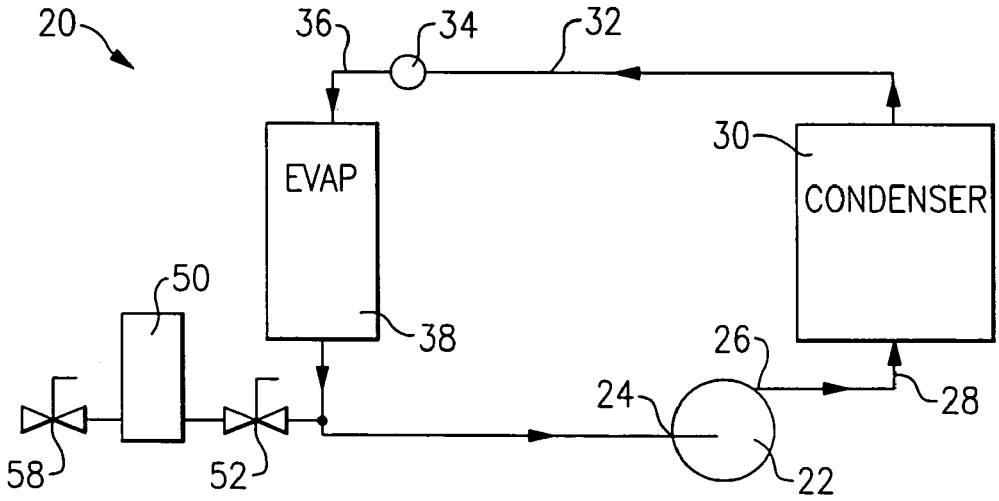
FIG. 5 schematically illustrates another example arrangement of a system designed according to this invention.

The example of FIG. 5 includes an optional access valve 58 that allows for reclaiming refrigerant from the receptacle 50 or initially pressurizing the receptacle 50 with a selected amount of refrigerant to a specified pressure.

The receptacle 50 may be at vacuum or contain a small amount of refrigerant during system assembly and charging with the refrigerant, at a factory, for example. Any refrigerant within the receptacle 50 preferably is kept at a pressure well below the pressure of the non-operating system to maximize the amount of refrigerant that can flow into the receptacle 50 in the event that the pressure in the system exceeds the selected threshold.

When refrigerant is released into receptacle 50, preferably there is a visible indication of when the refrigerant release has occurred. This allows a technician to have a visual confirmation that refrigerant was released into the receptacle 50. If that did occur, a technician can add charge to the system to account for any refrigerant that was transferred into the receptacle during shipping or storage. In most probable scenario, the pressure relief device will not have been activated and the technician can proceed with system installation as normal.

In some of the illustrated examples, the external receptacle 50 may be selectively removed from the system once the system is installed at the selected site so that the receptacle can be reused with another system that will be charged in a factory. Alternatively, if the receptacle 50 is connected to low pressure side of the system, it may be left in place and the pressure relief device 52 set for activation in the unlikely event that the low pressure side becomes over-pressurized during system operation.

The illustrated examples provide cost effective ways to handle low side system over-pressure during shipment or storage to prevent overpressurisation above an established, acceptable limit.

The preceding description is exemplary rather than limiting in nature. Variations and modifications to the disclosed examples may become apparent to those skilled in the art that do not necessarily depart from the essence of this invention. The scope of legal protection given to this invention can only be determined by studying the following claims.

We claim:

1. A refrigerant system comprising:

a compressor in fluid communication with a condenser that is in fluid communication with an expansion device that is in fluid communication with an evaporator that is in fluid communication with the compressor, the condenser, expansion device, evaporator and compressor cooperating to selectively alter a temperature of a fluid external to the system, one side of the compressor being a low pressure side of the system;

a refrigerant receptacle; and a pressure relief device that couples the receptacle to the system to automatically allow refrigerant from the system to flow into the refrigerant receptacle if pressure in the system exceeds a selected threshold for the low pressure side, the pressure relief device including an access valve coupled with the refrigerant receptacle for at least one of selectively reclaiming refrigerant from the receptacle, adding refrigerant to the receptacle, or pulling vacuum on the receptacle, the pressure relief device also including a directional valve between the access valve and the system that allows refrigerant flow only from the system toward the receptacle.

2. The system of claim 1, where the refrigerant receptacle is connected to the low pressure side of the system.

3. The system of claim 1, wherein the pressure relief device comprises a pressure relief valve that opens responsive to the pressure in the system exceeding the threshold for the low pressure side.

4. The system of claim 1, wherein the pressure relief device comprises a rupture disc that ruptures responsive to the pressure in the system exceeding the threshold for the low pressure side.

5. The system of claim 1, wherein the access valve is on one side of the refrigerant receptacle and the directional valve is on an opposite side of the receptacle.

6. The system of claim 1, including a releasable connection between the receptacle and the system that allows the receptacle to be selectively removed from the system.

* * * * *